US005545287A

United States Patent [19]

Carlson

[11] Patent Number: 5,545,287

[45] Date of Patent: Aug. 13, 1996

[54] FINISHING TOOL FOR COMPLETING A TAPED WALLBOARD JOINT

[75] Inventor: Carl A. Carlson, 2839 Eddington Ave., Bensalem, Pa. 19020

[73] Assignee: Carl A. Carlson, Bensalem, Pa.

[21] Appl. No.: 281,404

[22] Filed: Jul. 27, 1994

[51] Int. Cl.[6] ..... B44C 7/08

[52] U.S. Cl. ..... 156/575; 156/577; 156/579; 156/574; 156/71; 15/235.3; 15/235.4

[58] Field of Search ..... 156/577, 575, 156/579, 576, 574, 71; 15/235.3, 235.4

[56] References Cited

U.S. PATENT DOCUMENTS

| | | | |
|---|---|---|---|
| 3,625,798 | 12/1971 | Ihli | 156/577 X |
| 4,592,797 | 6/1986 | Carlson . | |
| 4,707,202 | 11/1987 | Sweeny | 156/577 X |

FOREIGN PATENT DOCUMENTS

| | | | |
|---|---|---|---|
| 2677390 | 12/1992 | France | 15/235.3 |
| 0887778 | 12/1981 | U.S.S.R. | 15/235.4 |
| 0953148 | 8/1982 | U.S.S.R. | 15/235.4 |

*Primary Examiner*—David A. Simmons
*Assistant Examiner*—Steven J. Helmer
*Attorney, Agent, or Firm*—Dann, Dorfman, Herrell and Skillman, P.C.

[57] ABSTRACT

Tools for finishing joints at flat surfaces or corners of wallboard walls after adhesive and tape have been applied are attached to the applicator tool by a rotatable yoke connection near the roller of the applicator so that the finishing tool will follow the applicator tool. The finishing tool includes a roller rotatable about an axle for embedding tape into the adhesive. Frame structure rotatably supported on the roller axle is provided with trowel means having a working surface moving parallel to the wallboard surface and placed close to the roller, at least on the sides, to spread adhesive pressed from under the tape back over the tape. Finishing means attached to the frame structure to follow the trowel collects the excess adhesive and distributes it in a smooth surface generally in the plane of the wallboard, filling in any voids left by trowel action. A cylindrical roller is used for joints in flat wallboard. A finishing tool having a complex roller having a base-to-base dual right frustoconcial form with an axle on the common axes of the cones and conical surfaces meeting at an angle of no more than 90° is used in the corner.

10 Claims, 4 Drawing Sheets

FINISHING TOOL FOR COMPLETING A TAPED WALLBOARD JOINT

FIELD OF THE INVENTION

The present invention relates to a tool for finishing a wallboard surface, and in particular for finishing the joints between adjacent sheets of wallboard. More particularly, the present invention relates to an attachment tool for a taping tool which simultaneously applies joint compound and tape over the joint. The attachment tool follows the taping tool to which it is attached and finishes the joint to provide a wallboard surface that appears smooth and continuous. Improvements to the attachment tool also can be used with separate finishing tools to be used after the tape has been applied to the joint.

BACKGROUND OF THE INVENTION

The joints between adjoining wallboards routinely require finishing to create a wall surface which appears smooth and continuous. The initial finishing step comprises applying a layer of adhesive over the joint and partially embedding a layer of tape over the adhesive using a tool well known in the trade as a "Bazooka."

After initial application of adhesive and tape with the "Bazooka" or by hand, the tape is manually troweled or scraped to further embed the tape into the adhesive and force adhesive into the recessed joint. Simultaneously, excess adhesive, which was squeezed out at the sides of the tape, is reapplied over the outer surface of the tape and troweled to cover the tape and smooth out the joints so that the joint effectively disappears and becomes a flat and even continuation of the wallboards. This troweling process can be performed using various hand trowels disclosed in the prior art. Hand troweling, however, is a time consuming and laborious task.

To save time and labor compared to hand troweling, Carlson, U.S. Pat. No. 4,592,797, describes a tool which finishes joints after the initial layer of adhesive and tape have been applied. The Carlson tool performs the aforementioned hand troweling tasks with one pass or traverse of the tool along the length of the joint.

During the process of finishing the wall surface of a work area, workmen commonly finish the taping work using the "Bazooka" and only then use the tool described by Carlson to complete the finishing of all joints in the work area. Workmen usually apply the initial layer of tape and adhesive to each of the wallboard joints in the work area before putting down the "Bazooka." Then, the workmen finish each of the joints in the work area by traversing the length of each joint using the tool described by Carlson to provide a smooth finished surface.

Using the tool described by Carlson in the manner described above provides a finished surface superior to manual troweling and finishing. It has been discovered, however, that an unexpected improvement in surface finish results by traversing the joint with a tool such as described by Carlson immediately after the adhesive and tape have been initially applied using the "Bazooka." However, from a time and motion standpoint, sequentially using the "Bazooka" and the tool described by Carlson at each joint before going to the next would be an inefficient use of time.

SUMMARY OF THE INVENTION

The present invention provides a combination tool for applying tape and finishing joints between adjacent sheets of wallboard at a single traverse of the joint and resulting in an improved finished surface. The tool of the present invention finishes the joint immediately after the adhesive and tape have been initially applied over the joint. The same combination tool initially applies finishing tape and adhesive to the joint, and further finishes the tape/adhesive composite immediately thereafter before the tape absorbs enough moisture from the adhesive to begin wrinkling. The present invention performs each of these functions in a single pass of the tool over the length of the joint.

The present invention uses a conventional taping tool which applies adhesive to a wallboard joint and thereafter applies tape over the adhesive and embeds the tape into the adhesive. It also uses an attachment tool, which may be temporarily or permanently attached to the taping tool. The attachment tool follows the taping tool on the wallboard surface and further embeds the tape into the adhesive, reapplies and trowels finishing adhesive over the finishing tape, and then scrapes and collects the excess finishing adhesive applied over said joint.

More specifically the present invention relates to an attachment tool for use with a tool for applying tape to a joint and wallboard and the like. The attachment tool is provided with yoke means which may be rotatably attached to the frame of the tool for applying tape allowing the attachment tool to follow the tool for applying tape and finish the joint in one pass. The yoke is rotatably attached to a roller for embedding tape into the adhesive. The roller includes an axle about which the roller rotates. A frame structure, including trowel means, is rotatably supported on the roller axle so that the frame structure closely embraces the roller, at least on the sides. The trowel functions to spread the adhesive over the embedded tape. Finally, finishing means is provided for further spreading the adhesive over the tape and leaving a smooth surface generally in the plane of the wallboard.

The attachment tool comes in two forms, one for finishing joints in flat wallboard surfaces and one for finishing joints in corner junctions of wallboards. The flat wallboard tool employs a roller of generally cylindrical form. The trowel means embraces the roller at least on the sides and the back away from the direction of movement. The trowel lies generally in a plane parallel to a plane tangent to the roller and may have a curvature about an axis parallel to the roller, but of much greater radius than the roller. The finishing means has a generally U-shaped frame which is spaced from and generally embraces at least a major portion of the trowel which is open in the direction of motion. Finishing means is attached to the trowel means by flexible means allowing the finishing means to float relative to the trowel.

The attachment tool for corners has a roller which is in the form of base to base dual right frustoconical form and has its axle on the common axis of the cones. The conical portions of the cones meet at an angle of no more than 90°. The trowel means is rotatably supported relative to the axle and includes two separate frame pieces and trowel members, one at each side of the roller, each of which trowel members has at least two surfaces at angles to one another. One of the surfaces is designed to ride generally in a plane tangent to one of the conical faces of the roller. The finishing means comprises at least a yieldable folded sheet member which is rotatably supported on the axle and provides surfaces at an angle on the order of 90° to one another. Spring means is provided between each frame piece and the finishing means tending to urge the finishing means into the respective surfaces of the corner.

DESCRIPTION OF A PREFERRED EMBODIMENT

Figure 1:
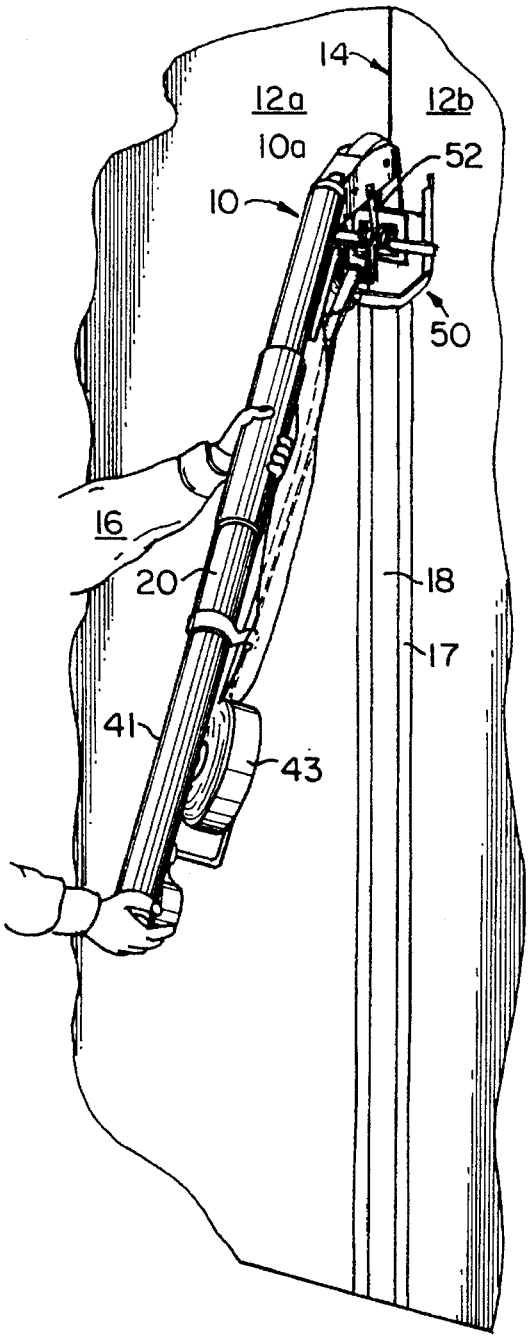
FIG. 1 is a perspective view of a workman using a tool for applying tape to a flat joint and wallboard of the attachment tool of the present invention rotatably attached thereto and operating to complete the joint.

The tool, designated generally by reference numeral 10, is used for finishing joints 14 between adjacent sheets of wallboard 12*a*, 12*b* as seen in FIG. 1. A workman operates the tool by traversing the length of the joint 14 (generally from bottom to top in FIG. 1). As the tool traverses the length of the joint, the tool applies a composite layer of adhesive 17 over the joint 14 and partially embeds a layer of tape 18 into the adhesive. Simultaneously and immediately thereafter, a following part of the tool in accordance with the present invention finishes the joint 14 by further embedding the tape 18 into the adhesive 17, thereby forcing adhesive into the joint depression at the edges of the wallboard and squeezing excess adhesive outwardly from the sides of the tape. The excess adhesive is reapplied over the outer surface of the tape, troweled and scraped to form a smooth layer of adhesive and tape covering the joint and blending the joint into the surface of the wall. The tool simultaneously performs each of these functions upon a single pass or traverse of the tool. After the adhesive cures, the joint is sanded to further improve the surface texture.

The tool 10 as described to this point may be a tool known in the art and sold under the trademark "Bazooka", registered trademark of Ames Tools, Belmont, Calif. or a similar tool. The tool is an automatic taper and functions to apply adhesive or "mastic" to the back of the tape and apply tape in the wall particularly at the junction of wallboards. The present invention adds to the "Bazooka" type tool a secondary trailing tool similar to the tool described by Carlson in U.S. Pat. No. 4,592,797. The secondary tool includes improvements to the patented tool which may also be incorporated in that tool and used without the Bazooka if desired.

The tool 10 comprises an elongated hollow tube 20 which provides a handle which can be easily grasped by a workman 16 adjacent opposite ends. The handle also supports several components at the head end 10a of the tool 10 arranged in a predetermined sequence for performing the aforementioned functions in a selected order. Thus, the tool can be operated properly in only one direction, i.e., head end leading the tool. In this regard, while the length of the joint is preferably traversed from the bottom of an interior surface to the top as shown in FIG. 1, a joint may be traversed from top to bottom provided the tool is oriented in the direction opposite of that shown in FIG. 1. Similarly, the length of a horizontal joint may be traversed in either direction provided the head of the tool is leading the action path of the tool 10.

At the head end 10*a*, the tool includes a tape feed and mastic applicator in a housing 30 for applying an initial layer of finishing adhesive to the tape 18 prior to passing around the applicator roller 32 on the side of the tape opposite the roller. The applicator roller 32, in turn, applies the tape 118 and adhesive 17 to the wall at the joint with pressure which spreads the mastic beyond the edges of the tape. The adhesive applicator also includes a supply container which extends from the head of the tool into the tubular interior of the handle. The spreader applies transversely to the joint a layer of adhesive extending somewhat wider than the width of the tape. Depending upon the angle at which the tool is placed against the interior surface, the spreader may apply the initial layer of adhesive either directly on the joint or directly on the interior surface of the tape immediately before the tape is applied to the joint.

The tool further includes an applicator roller 32 for applying finishing tape over the adhesive onto the wallboard at the joint and partially embedding the tape into the adhesive in the process. The applicator roller 32 is rotatably supported on the housing walls 54 about an axle 32*a* which is placed parallel to the wall during application when the roller presses the tape and adhesive against the wall. The tape applicator roller 32 fed from a tape supply 43, is preferably totally supported on a spindle 41 on the handle 20, out of the way of a user remote from the head. The applicator roller 32 draws from the supply as tape is applied to the wall. The applicator roller 32 has a pinion sprocket 33 mounted at its axle 32*a*. The pinion sprocket drives a chain 35 which, in turn, drives sprocket wheel 36 fixed to a spool (not shown) rotatably supported on shaft 34*a*. The spool, in turn, is supported on sidewalls 54 of housing 30, and includes a sprocket wheel driven by chain 35. The spool winds up cable attached to a piston in the adhesive supply chamber in the tubular handle. Then, as the spool is wound with the cable, the piston is pulled up the inside of the tube handle 20 forcing the adhesive ahead of it. The adhesive is fed to the tape or directly to the joint as the tool traverses the joint.

Figure 2:
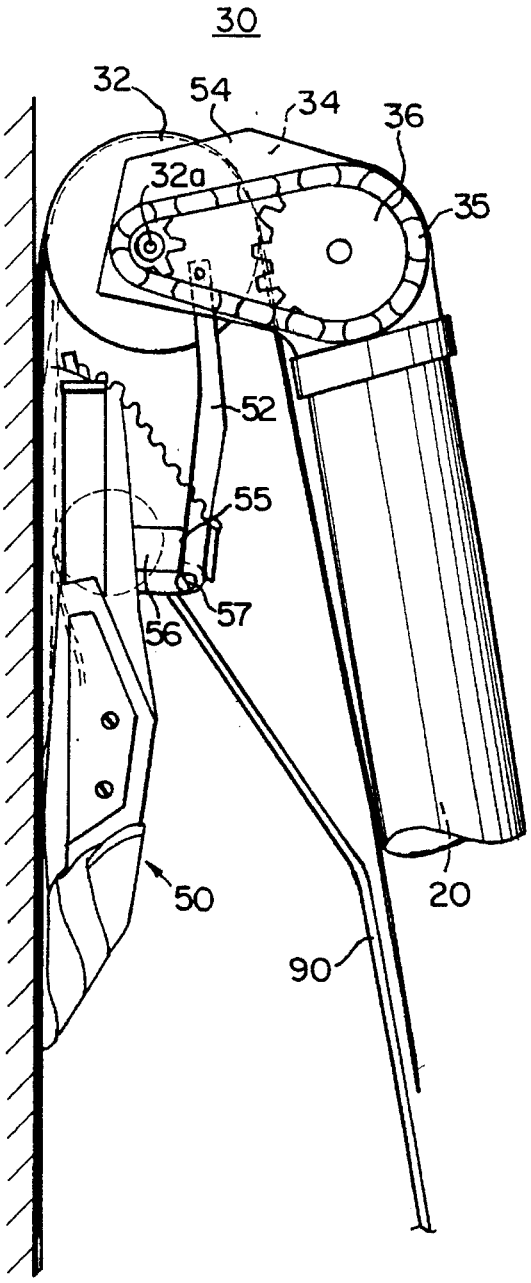
FIG. 2 is a side elevational view of the end of the tool for applying tape with the attachment tool attached.

The trailing attachment tool, generally designated 50, is rotatably mounted on the sidewalls 54 of housing 30 at the head end 10*a* of the tool proximate to, but trailing the tape applicator roller 32 in the direction the tool is moved to apply tape. The attachment tool is connected by a yoke 52 as seen in FIGS. 2 and 3, which is rotatably mounted by pins 53 to parallel sidewalls 54 of the head of the tape application housing 30. The attachment tool is positioned to perform the troweling and scraping functions broadly described above.

Figure 3A:
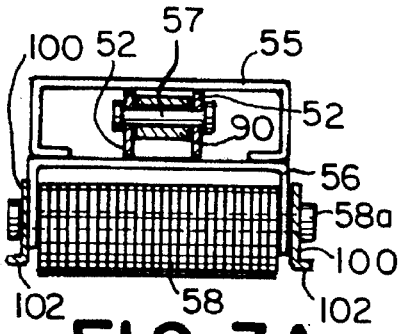
FIG. 3A is a sectional view taken along line 3*a*—3*a* of FIG. 3.
Figure 3:
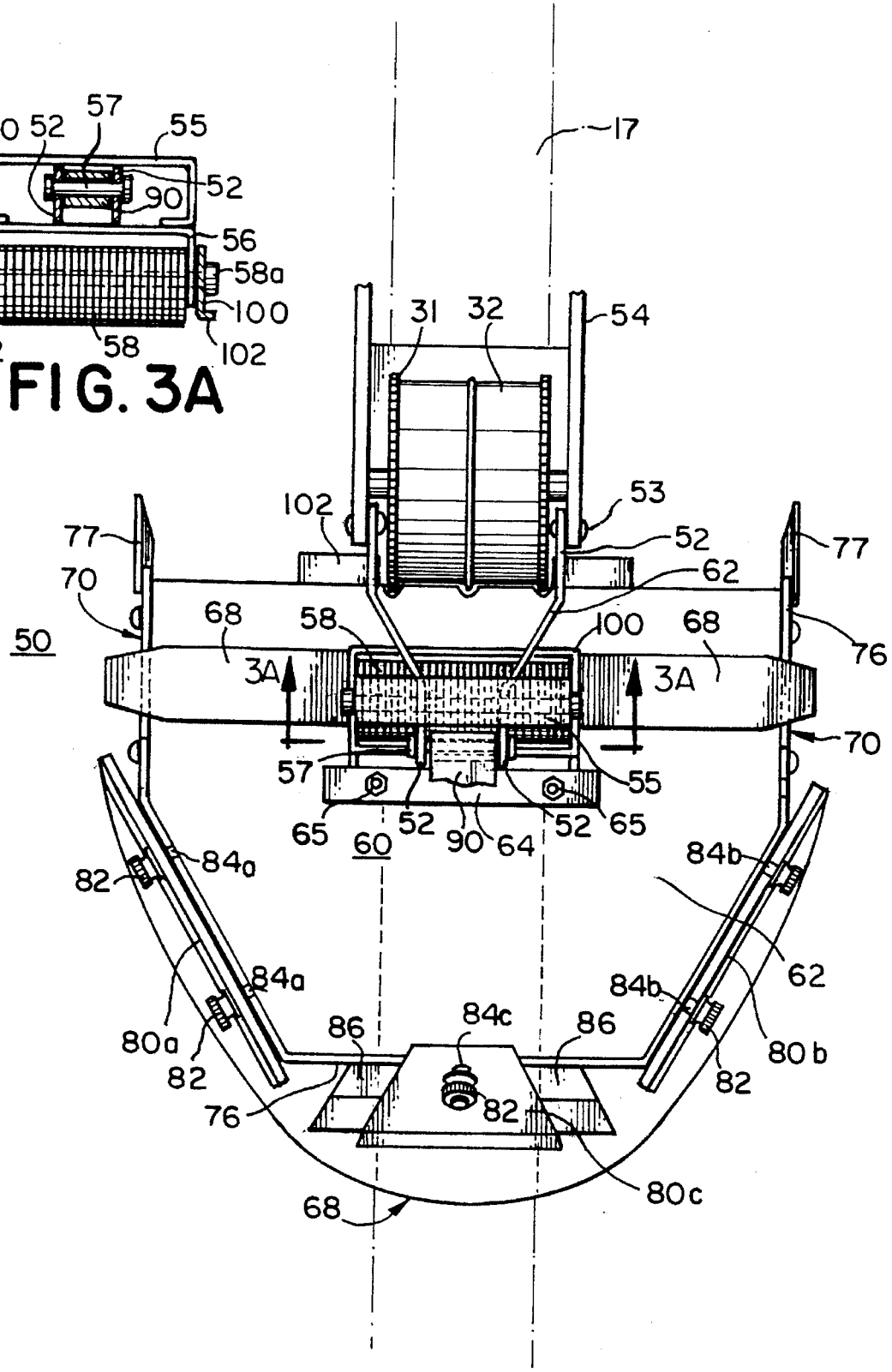
FIG. 3 is a plan view from above showing the attachment tool of the present invention attached to the tool for applying tape.
Figure 4:
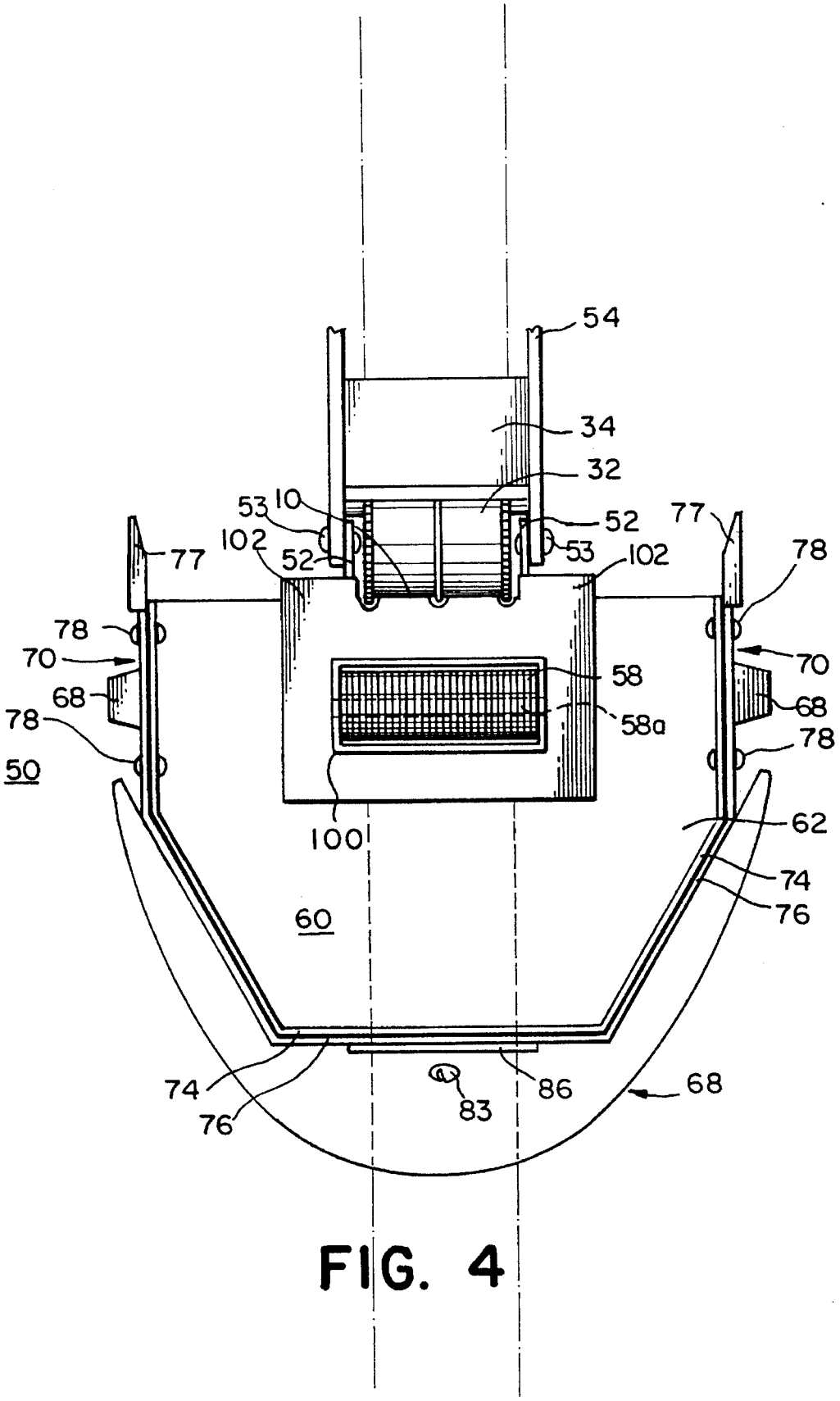
FIG. 4 is a plan view from below showing the opposite side of the same structure as shown in FIG. 3.

Referring to FIGS. 3, 3A and 4, a preferred embodiment of the attachment tool is shown. The shape and nature of the yoke 52 is seen in FIGS. 2, 3 and 3A. The nature of the connection is best seen in FIG. 2. As seen in FIG. 3, rotatable pin connections to the sidewalls 54 of the structure is made by means of fasteners 53. The yoke is clamped between brackets 55 and 56 as seen in FIG. 3A. As seen in FIG. 2 the yoke 52 extends beyond the clamp means to provide a pin 57 about which the actuator 90 is rotatably connected. The brackets 55 and 56 which tightly clamp yoke 52 between them effectively provide a rigid crank arm connecting the yoke 52 to a segmented roller 58 through pin 58*a*. The pin 58*a* also rotatably connects the frame 100 supporting trowel 102. The frame 100 closely surrounds roller 58 and effectively defines and extends the opening through the trowel 102. The trowel 102 is a generally planar structure preferably with a slight curvature having a radius of curvature much larger than that of the roller 58. The roller 58 protrudes slightly below the trowel.

The trowel lies within a frame defined by a pair of generally U-shaped bars 74, 76, which in this case are bent to a semi-polygonal form, but could have various shapes. As seen in FIG. 4, the two bars 74 and 76 are formed to very closely fit together. Between them, somewhat in the fashion of embroidery hoops, is placed a flexible sheet, preferably of elastomeric material such as rubber, which is clamped in a semi-stretched condition. Examining FIGS. 3 and 4 together, it will be seen that the elastomeric sheet 62 is stretched over the top side of the inner frame member 74 and then outer frame member 76 put in place and fasteners 78 are passed through openings in position to hold the pieces together and tightened. The rubber as in FIG. 3 overlaps to the side of trowel 102, but is provided with an opening which fits around the frame 100 for the roller so as not to interfere with its operation, as best seen in FIG. 3. Also in FIG. 3 there is seen a bar 64 which clamps the rubber sheet in place to the trowel using fastening means 65 passing through the bar and the trowel as well as the sheet.

The frame structure 70 with its frame members 74 and 76 is very loosely coupled to the trowel 102 through the flexible sheet 62. The trowel 102 itself may be retracted from the work surface of the wallboard by actuator arm 90, which effectively pivots the structure of the trailing tool about pins 53 on the yoke 52 back at the structure of the tool for applying tape. When the trowel is to be applied to the work surface the actuator 90 reverses the process and is positioned to impose pressure to hold the trowel to the work surface through the actuator arm 90 and its pivot 57 down through the structure of FIG. 3A to the trowel. Because of its loose coupling, however, the scraper structure 70 may not follow as well as the trowel on the surface of the wallboard and over the material being applied to the joint. To ensure better contact and more effectiveness of the scraper, the leaf spring elements 68 attached to the frame box 100 may be selected to apply sufficient pressure to normally keep the scraper in contact with the work surface, but allowing release against the spring force to avoid damage to the tool. Since the force tends to concentrate at the leading edge ends of the frames, force distributing runners 77 may be provided as shown using shaped pieces of angle material. In usual situations the scraper collects excess adhesive and reapplies it to the joint in a smooth fashion.

Aiding in the work of the scraper is a trailing skirt 68 advantageously made of a rubber sheet-like member 62, but which could be made of other materials which have sufficient strength, wear resistance and resiliency. The skirt 68 is held to the frame by clamp plates 80*a* and 80*b* to fit against the diagonal polygonal sections of the frame which provide transition from the side to the back wall thereof. The clamp members 80*a* and 80*b* are resilient sheet metal pieces bent slightly outward away from the frame toward their bottoms. They are provided with slot 84*a* and 84*b*, respectively, which extend generally vertically downward from the top edge of the piece and afford adjustment of the position of the clamp plates relative to the skirt 68. This is done by releasing and then, after adjustment of the clamp plates, retightening the thumb nuts 82. By raising the clamp plates, downward pressure is removed from the skirt to a certain degree and by lowering the clamp plates, the pressure is increased, allowing the workmen to adjust the skirt to handle different consistencies of adhesive for a better job. The clamp plate 80*c* is a similar member, but it is supported on an inverted V-shaped member 86. One leg of the V-shaped member 86 is attached to the back segment of frame member 76 and the skirt fits under the free piece extending diagonally downward away from the back part of the frame. Clamp plate 80*c* is similar to clamp plates 80*a* and 80*b*, except for the angle. Clamp plate 80*c* is provided with an outwardly flared edge at the bottom to contact the skirt 68, again for supplying variable pressure which is achieved by adjustment along slot 84*c* by loosening and retightening its thumb nut 82. In FIG. 4, the head of a screw 83 engaged by the thumb nut 82 is shown beneath the skirt. As seen, the screw head 83 is made sufficiently large to provide a good bearing surface against the rubber which it holds in place to the outer surface of member 86, but alternatively the screw head may be backed by a plate to make sure it does not pull through the rubber sheet. In use, the skirt 68 is dragged across the adhesive as the scraper box passes over the joint and acts to further smooth the surface of the joint.

Figure 5:
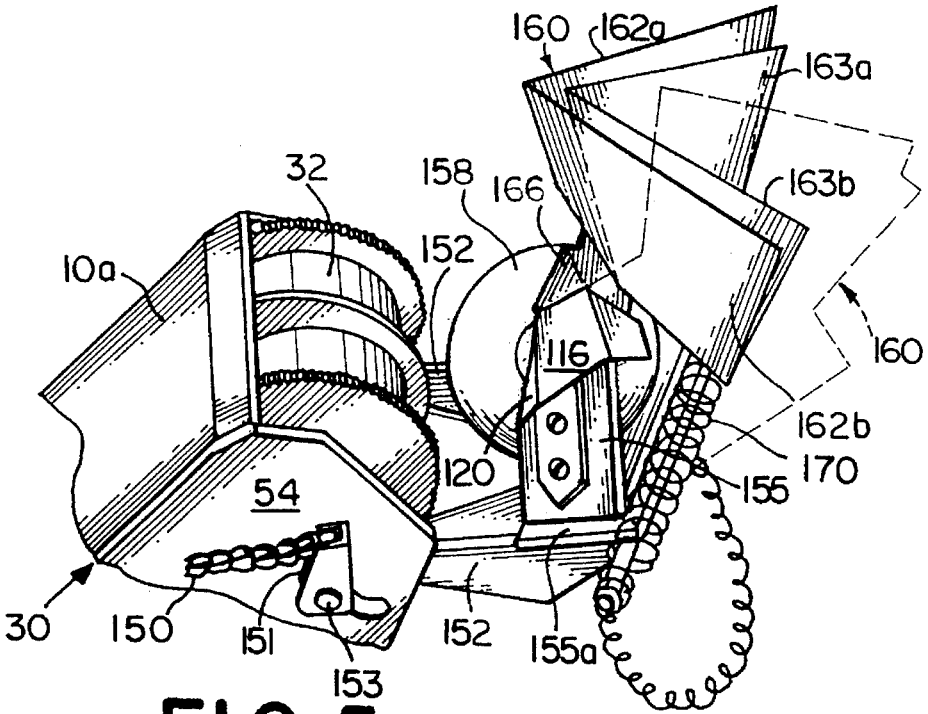
FIG. 5 is a perspective view showing the corner attachment tool attached to the tape applying tool.
Figure 6:
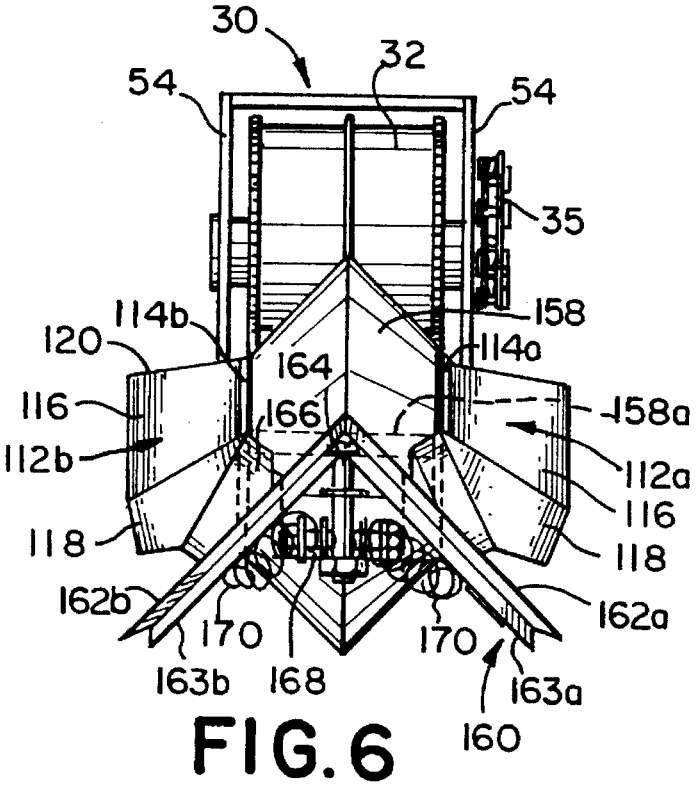
FIG. 6 is an elevational view of the same structure.

Referring now to FIGS. 5 and 6, a modified type of trailing attachment tool is shown attached to the tape applicator of FIGS. 1 and 2. The tape applicator has the same structure, numbered in the same way, except that only a fragmentary portion of the head end 10*a* is shown in each of the drawings in FIGS. 5 and 6. With this type of attachment tool, the tape is applied to a corner joint to leave the adhesive and the tape lightly stuck at its edges to the walls forming the corner. Then the roller of the following attachment tool pushes the tape into the corner and against the respective walls. The trowel portion then covers the tape with adhesive extruded from the tape edges. Finally, a finishing tool smoothes the adhesive and fills in the portions which had not been previously covered.

In this case the attachment tool is again connected by a yoke structure 152 connected pivotally to the sidewalls 54 of the tape applicator structure. Attaching pin connectors 153 allow rotatable movement of the yoke about these pins. A crank arm 151 is attached to the pin 153 in the position shown and a chain 150 extends along the face of wall 54 passing over a pulley and terminating in a spring attached to the tape applicator. The effect of this structure is to apply a spring tension tending to aid the rotation of the trailing tool into the wall. Since the tool as illustrated is not shown against a wall corner, spring structures tend to urge the tool into the collapsed position shown, but the tool moves into proper position when brought in contact with the corner of a wall.

The yoke 152 is similar to the yoke 52 of FIGS. 2, 3 and 4 and is actuated at its end remote from the tape applicator by a linkage similar to 90 (not shown) to move into alternative positions against the wall or away from the wall as the operator desires. Supported on the yoke 152 is a generally U-shaped bracket 155 which preferably fits into a channel 155*a* in the yoke structure and is rigidly fixed to the yoke structure. Between the legs of the U is placed the roller 158 supported on an axle 158*a* shown in phantom in FIG. 6. Axle 158*a* provides a center of rotation of the various elements of the tool. In this case the roller is in the shape of a pair of base-to-base dual right frustoconical solids. The roller has its axle 158*a* on the common axes of the cones. The conical surfaces meet at an angle of no more than 90° to one another so as to be able to fit within a corner.

A trowel is provided for this tool in the form of independent members on each side of the roller 158 and supported by the axle 158*a*. The trowel members are generally designated 112*a* and 112*b* in this embodiment. Each trowel is a mirror image of the other and consists of three faces 116, 118 and 120. A support flange 114*a* and 114*b* for the respective trowel members is bent to an obtuse angle to each face 116 and is rotatably supported on the axle 158*a* on opposite sides of the roller between the roller 158 and the legs of U-shaped support bracket 155. While it is difficult to see from the drawings, the trowel members are meant to be extensions of the conical faces of the roller 158 and ordinarily face 116 rests on the same surface of the wallboard as that conical face of the roller. The leading surface 120 will tend to catch and deflect adhesive under the face 116. Face 118 may aid in finishing but in some applications may be omitted. It will be understood that the trowel members 112*a* and 112*b* are separately adjusting.

A finishing means generally designated 160 is made of sheet metal folded on itself along a long axis to provide a very narrow V. A bend of approximately 90° is provided at the leading face of the structure and in the middle of the structure, as shown. These bends leave discrete panels 162*a*, 162*b*, 163*a* and 163*b*. A screw member 164 at the vertex between panels 163*a* and 163*b* is rigidly anchored and reinforced as necessary to provide the principal support of the structure. A sheet metal yoke 166 is folded over the bolt 164 and clamped in place by a further bolt 168 together with spring members to be described. It is then formed to diverge around the double conical faces of roller 158 and its ends are bent into parallel portions reaching the axle on which they are respectively rotatably mounted on opposite sides of the roller 158. It should be noted that the structure of the support requires bending and forming which may be done in different ways and expands from the narrow support structure over the bolt 164 to a somewhat wider structure as seen in FIG. 5 beneath the panels 162*a* and 162*b*.

Finally, each of spring members 170 is also clamped at one end by the same bolt and nut structure 168 holding finishing tool yoke 166 and is affixed at the other end to the connection yoke 152 which connects the whole attachment tool to the main tape applicator tool. As the finishing tool 160 is rotated back to the dashed line position, springs 170 are bent into a loop as shown. It will be understood that springs 170 provide a force urging the folded finishing tool into the corner to provide a final finishing and troweling of the adhesive over the tape in a final smooth surface. The panels 162*a* and 162*b* in particular on the faces which are pressed against the wall may be given a concave curvature. The resilience of the sheet metal of these panels will yield as they are passed against the wall and will provide a spring effect which allows these surfaces to apply relatively even pressure throughout their length due to the effort of the resilience of the sheet metal panels to restore the curvature which has been flattened against the wall. Appropriate materials to permit this effect should be used.

Various other forms of the finishing tool, of course, may be employed providing a V-shaped surface generally urged into the wall and applying pressure throughout the length. It will also be apparent that various types of alternative support may be employed to rotatably support the finishing structure. The same is true of the trowel means. However, in general, both structures will perform best if they are free to rotate about axes in common with the roller 158.

Various modifications have been suggested for the specific embodiments shown, and other modifications will occur to those skilled in the art. All such variations and modifications to the structure as shown, within the scope of the claims, are intended to be within the scope and spirit of the present invention.

I claim:

1. An attachment tool for use with a tape applying tool for applying adhesive followed by tape over a joint in wallboard, and the like, so that the attachment tool will immediately cover the tape and finish the joint before the tape absorbs moisture from the adhesive and becomes wet, comprising:

a frame structure, including trowel means;

linkage means rotatably connected at one end of the linkage means to the frame structures and at the other end connectable to the tape applying tool by connection means permitting rotation about an axis parallel to the axis of the rotatable connection to the frame structure;

a roller for embedding tape into the adhesive rotatably supported on the frame to rotate about an axis parallel to the axis of the linkage means connection and positioned so that the trowel means is generally tangential to the roller where it embeds the tape, the roller projecting beyond the trowel into the tape, and so that the trowel immediately follows the roller relative to a direction of movement of the tape applying tool during application of tape and adhesive, for spreading the adhesive over the embedded tape; and finishing means connected to the frame structure by flexible sheet means to follow the trowel means relative to a direction of movement of the tape applying tool during application of tape and adhesive, for further spreading the adhesive over the tape and leaving a smooth surface generally in the plane of the wallboard, whereby the flexible sheet means allows the finishing means to float relative to the frame structure.

2. The attachment tool of claim 1 all in which the roller is generally cylindrical in form, the trowel means embraces the roller at least on the sides and back, away from the direction of movement of the tape applying tool during application of the tape and adhesive, and has a curvature on the axis generally parallel to that of the roller but the curvature has a radius much greater than the radius of the roller and the finishing means has a generally U-shaped frame which is spaced from and generally embraces a major portion of the trowel means, is open in the direction of movement of the tape applying tool during application of tape and adhesive, and is attached to the frame structure by flexible sheet means allowing the finishing means to float relative to the frame structure.

3. The attachment tool of claim 2 in which the U-shaped frame of the finishing means supports a skirt of flexible material connected to the U-shaped frame by sheet biasing means fixed to the frame at spaced locations around the frame and bearing against the skirt to yieldingly urge the skirt against the wallboard so that the skirt where it touches the wallboard and adhesive may assume a position approaching parallel thereto.

4. The attachment tool of claim 3 in which the flexible means connecting the frame to the trowel means is a sheet of flexible and resilient material.

5. The attachment tool of claim 4 in which the generally U-shaped frame is open in the direction of movement during use is provided at each end with runner means presenting a flat narrow surface to the wallboard or any adhesive contacted.

6. The attachment tool of claim 5 in which an actuator linkage is provided with a rotatable connection to the frame structure allowing the attachment tool to be rotated about the rotatable connections of the linkage means to permit the attachment tool to be moved away from or into the wallboard selectively in response to movement of the actuator linkage.

7. The attachment tool of claim 6 in which the actuator linkage and the linkage means are both rotatably connected at the frame structure spaced transversely away from the roller and the trowel.

8. The attachment tool of claim 1 in which the roller is of base-to-base dual right frustoconical form having a common axis along which is provided an axle and with the conical surfaces meeting at an angle of no more than 90°, frame structure comprising two separate frame pieces one at each side of the roller, each frame piece having a member rotatably supported on the axle of the roller and an integral trowel member, each of which frame members is at an angle to the other with the trowel member supported in position to move generally into a plane near tangent to one conical face of the roller and generally parallel to one wallboard surface at the corner and the finishing means comprising at least a flexible folded sheet member which is rotatably supported on the axle and provides surfaces at an angle of on the order of 90° to one another, and spring means is provided between each frame piece and the finishing means tending to urge the finishing means into the respective surfaces of a corner formed by adjacent wallboard pieces.

9. A tool for embedding tape in adhesive at a corner joint in wallboard, and the like, and covering the tape with adhesive to provide a smooth joint, comprising:

a roller of a base-to-base dual right frustoconical form having an axle on the common axes of the cones wherein the conical portions meet at an angle of no more than 90° in order to push the tape into the corner;

a supporting bracket providing a frame piece rotatably supported to the roller axle on each side of the roller;

two separate frame pieces supported on the axle, one at each side of the roller and each including a trowel member, each of which trowel members is supported in position to move generally into a plane near tangent to a different one of the conical faces of the roller and generally parallel to one wallboard surface at the corner;

finishing means comprising at least two flexible folded members which are rotatably supported on the axle and provide surfaces at an angle of on the order of 90° to one another to fit into a corner to be finished and at some angle to the wall to function as a scraper; and spring means between each frame piece and each finishing means tending to urge the finishing means into the respective surfaces of a wallboard corner.

10. An attachment tool for use with a tape applying tool for applying adhesive followed by tape over a joint in wallboard, and the like, so that the attachment tool will immediately cover the tape and finish the joint before the tape absorbs moisture from the adhesive and becomes wet, comprising:

a frame structure, including trowel means;

linkage means comprising a pair of generally parallel arms rotatably connected at one end of the linkage means to the frame structure to rotate about an axis parallel to an adhesive working surface of the trowel means and at the other end connectable to the tape applying tool by connection means permitting rotation about an axis parallel to the axis of the linkage means connection to the frame structure and rotatable connection to the frame structure;

a generally cylindrical roller for embedding tape into the adhesive rotatably supported on the frame to rotate about an axis parallel to the axis of the linkage means connection and positioned so that the trowel means is generally tangential to the roller where it embeds the tape, the roller projecting beyond the trowel into the tape, and the trowel means generally embracing the roller at least at the ends of the roller and following the surface of the roller in the direction of movement of the tape applying tool during applications of tape and adhesive and so that the trowel immediately follows the roller for spreading the adhesive over the embedded tape;

finishing means having a generally U-shaped frame which is spaced from and generally embraces a major portion of the trowel means and is open in the direction of motion for further spreading the adhesive over the tape and leaving a smooth surface generally in the plane of the wallboard; and flexible sheet means attached between the trowel means and the U-shaped frame allowing the finishing means to float relative to the trowel means.

* * * * *